United States Patent [19]

Wittern et al.

[11] 4,440,285

[45] Apr. 3, 1984

[54] ADJUSTABLE PRICE SETTING MECHANISM FOR A VENDING MACHINE

[75] Inventors: Francis A. Wittern, Des Moines; Arthur N. Wirstlin, Altoona, both of Iowa

[73] Assignee: Fawn Engineering Co., Des Moines, Iowa

[21] Appl. No.: 391,565

[22] Filed: Jun. 24, 1982

[51] Int. Cl.[3] ..... G07F 5/08

[52] U.S. Cl. ..... 194/93; 194/1 L

[58] Field of Search ..... 194/2, 48, 57, 1 L, 194/DIG. 3, 93, 1 G

[56] References Cited

U.S. PATENT DOCUMENTS 3,139,167 6/1964 Wittern .

3,545,586 12/1970 Wittern .

*Primary Examiner*—Stanley H. Tollberg

*Attorney, Agent, or Firm*—Henderson & Sturm

[57] ABSTRACT

A vending machine has a frame comprising a newspaper holding compartment with a spring hinged door and a housing for a mechanical control system secured to the top of the holding compartment. A vending member is secured to the door and operably engaged with the control mechanism. The control mechanism includes a lever biased to a locking position with respect to the vending member. A lever holding rod is secured to the lever and has an "up", or unlocked, position wherein the lever does not lock the vending member, and a "down", or locked, position wherein the vending member is locked in position. A coin operated mechanism has an output shaft and cam which rotate in response to the insertion of a low price coinage amount to a first position, and a high price coinage amount to a second position. A second cam is mounted for free rotation on the coin mechanism shaft and is gravity biased to follow the first cam. The second cam follows the first cam to rotate freely to the first position wherein it holds the lever holding rod in the "up", or unlocked, position so that the vending member is unlocked. A lock out member which is operated by an exterior key is provided to block the free rotation of the second cam so that only the first cam rotates to the second position when the high price amount of coinage is inserted. In the second position, the first cam holds the lever holding rod in the "up" position so that the vending member is unlocked. A reset mechanism for the coin operated mechanism is provided.

9 Claims, 12 Drawing Figures

ADJUSTABLE PRICE SETTING MECHANISM FOR A VENDING MACHINE

BACKGROUND OF THE INVENTION

The present invention relates to control mechanisms for vending machines and more particularly to those which employ coin operated mechanisms having a cam which rotates to an angular position indicative of the amount of coinage inserted into the mechanism. Examples of such coin operated mechanisms are discussed in U.S. Pat. Nos. 3,545,586 and 3,139,169 which are incorporated herein by reference.

In control mechanisms for vending machines using such coin operated cam units, the cam generally, upon the insertion of the proper coinage, rotates to a position which blocks a lock-out member which would otherwise lock the vending member. When the lock-out member is blocked the vending member can vend a product.

A problem with these coin operated mechanisms has been the narrowness of the price range which such mechanisms are limited to.

In addition, where the vending machine vends products at different prices, a lock-out member, or lock-out lever holding rod, must generally be provided for each price.

Further, where the machine must be changed from a low price mode to a high price mode, it is normally required that the operator open the mechanism housing to adjust the internal workings of the machine.

Consequently, the cam type coin operated mechanisms of the prior art have been somewhat inflexible and limited when employed with machines having various price ranges over a wide range, or mutually exclusive price settings.

SUMMARY OF THE INVENTION

The present invention overcomes these various problems of the prior art by providing a cam structure for a coin operated mechanism of a control system which covers a wide range of pricing and can be used with a single lock-out member.

The present cam structure is a dual cam structure having a first cam fixed for rotation with the output shaft of the coin mechanism, and a second cam freely rotatable upon the shaft of the coin mechanism, but gravity biased to follow the second cam. The coin operated unit rotates to a first position in response to the insertion of the low price coinage amount, and to a second position in response to the insertion of a high price coinage amount. The second cam follows the first cam to a first position wherein it blocks the lock-out lever holding rod, and permits the low price article to be vended. When the high price article is to be vended, the rotation of the second cam is blocked and the high price article cannot be vended until the first cam rotates to the second position to block the lock-out lever holding rod. The control mechanism is enclosed in a housing and includes an external keyhole which receives a key to convert the mechanism from the low price to the high price mode by blocking the second cam.

It is, therefore, an object of the present invention to provide an improved control mechanism for a vending machine.

It is a further object to provide an improved cam structure for use with a coin operated mechanism of a vending machine.

It is another object to provide a dual cam structure for use with a coin operated mechanism of a vending machine.

It is a further object to provide a dual cam structure for a coin operated mechanism of a vending machine having a gravity biased cam mounted for free rotation.

Still another object is the provision of a control mechanism for a vending machine which can be converted from a low price mode to a high price mode by the use of an externally inserted key.

These and other objects, advantages and novel features of the present invention will become apparent from the following detailed description of the invention taken in conjunction with the accompanying drawings.

DESCRIPTION OF THE PREFERRED EMBODIMENT

The present invention is an improvement over U.S. Pat. No. 3,139,167 and U.S. Pat. No. 3,545,586.

Both of the above patented structures disclose a cam member rotatable by a coin operated mechanism operatively engageable with one or more lever holding rods. The lever holding rods typically have an up, or unlocked position, and are biased to a down, or locked, position. In the down position of the lever holding rods, the vending members are locked and disabled from vending a product. When the proper amount of coinage is inserted into the coin operated mechanism, the cam is rotated to a position below the lever holding rod, or rods, holding them in the up, or unlocked position, so that the vending members are operable to vend a product.

While U.S. Pat. Nos. 3,139,167 and 3,545,586 disclose a vending machine having multiple vending members, the invention is presently disclosed for simplicity in description with a newspaper type vending machine having a single vending member. It is to be understood, however, that the dual cam structure of the present invention would be equally applicable to such multi-vending member machines and to any machine utilizing rotating coin operated mechanisms in combination with lever holding rods.

Figure 1:
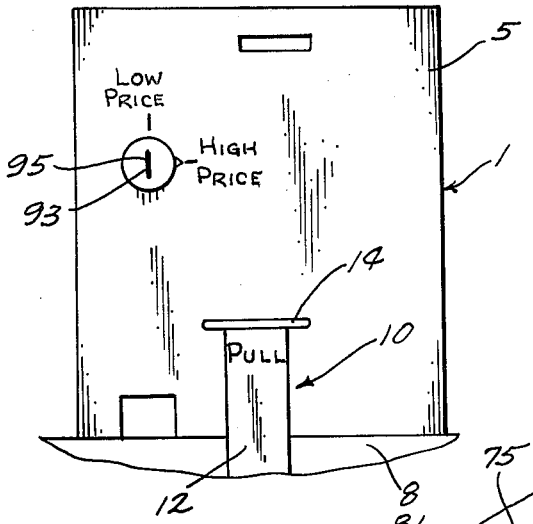
FIG. 1 shows a partial elevational view of a vending machine.
Figure 3:
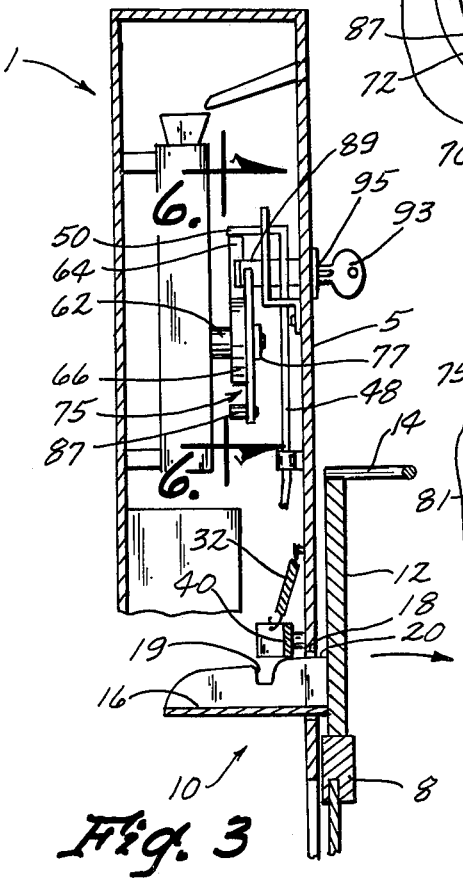
FIG. 3 shows a cross-sectional elevational view of the cam mechanism of the present invention taken along line 3—3 of FIG. 2.
Figure 2:
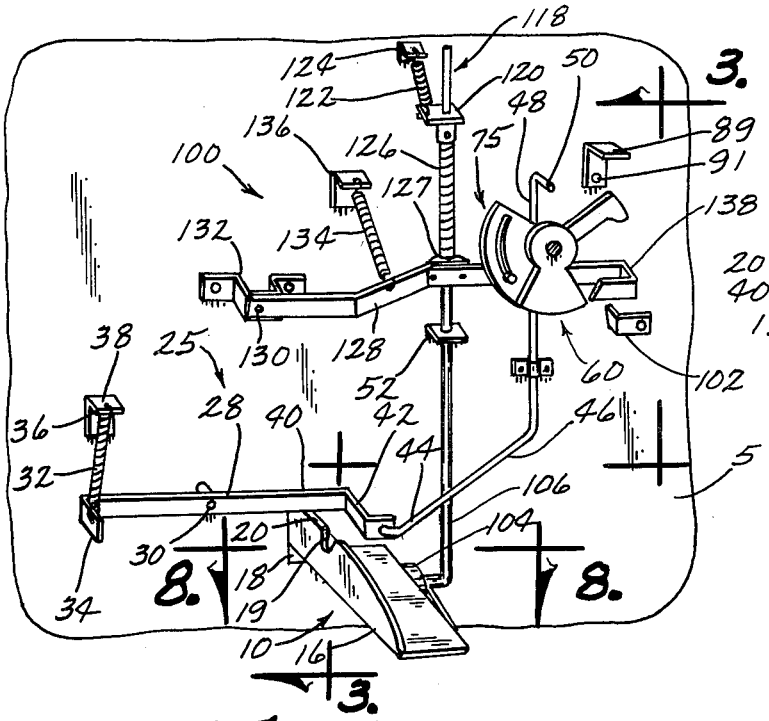
FIG. 2 shows a perspective view of the control mechanism of the present invention.
Figure 8:
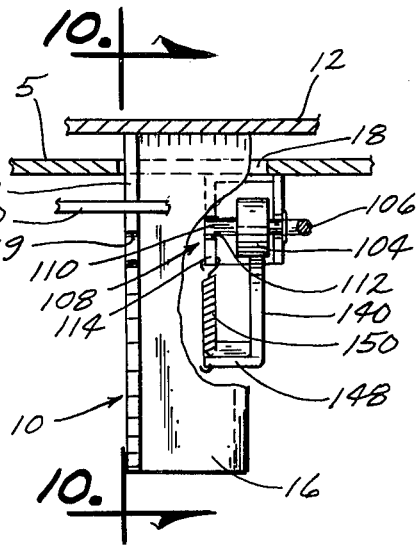
FIG. 8 is a cross-sectional view taken along line 8—8 of FIG. 2.

The multicam structure of the present invention is installed upon a newspaper type vending machine 1 having a control housing 5 which encloses the control mechanism of the present invention and is installed on the top of the vending machine 1. The newspaper holding portion of the vending machine is not shown, but a portion of the vending machine door 8 is shown in FIGS. 1 and 3. Door 8 is of the conventional type opening downwardly and having spring hinges (not shown) along its lower edge. A vending member 10 is shown attached to the upper portion of the door 8 in FIG. 1. Vending member 10 includes a rigid post member 12 secured to the door 8 and a handle 14 secured to the upper end of the post 12. A tongue member 16 rigidly extends from the rearward side of post 12 as shown in FIGS. 2 and 3. Tongue 16 is received within a suitable opening 18 in housing 5. Tongue 16 includes a lock-out notch 19 and a reset cam 22, later described. See FIGS. 10–12.

As shown in FIG. 2, the mechanical control mechanism 25 of the present invention is enclosed within housing 5.

The control mechanism 25 includes a lever 28 which is pivoted to housing 5 at pivot 30 and secured to a spring 32 at end 34. The other end 36 of spring 32 is secured to a bracket 38 which is in turn secured to the housing 5. Spring 32 is in tension and as such is pulling up on the end 34 of lever 28 in FIG. 2. Due to pivot 30, the opposite end 40 of lever 28 is biased downwardly, or clockwise, in FIG. 2, and as such, is pressing against the upper edge 20 of tongue 16. See FIG. 2. End 40 includes a projection 42 which is rigidly fastened to end 44 of lever holding rod 46. The upper end 48 of lever holding rod 46 includes a projecting finger 50. Rod 46 is slideably received within a bearing 52 which is suitablely secured to housing 5.

Figure 10:
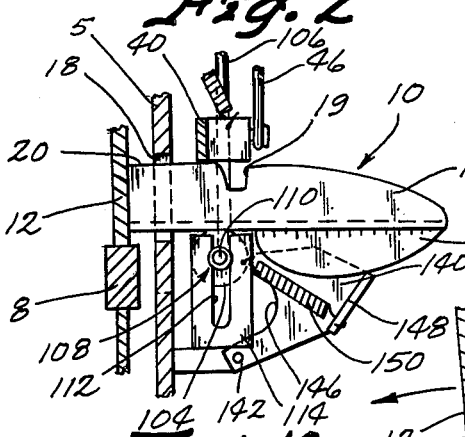
FIG. 10 is a cross-sectional view taken along line 10—10 of FIG. 8 and showing the vending member in the "in" position.
Figure 11:
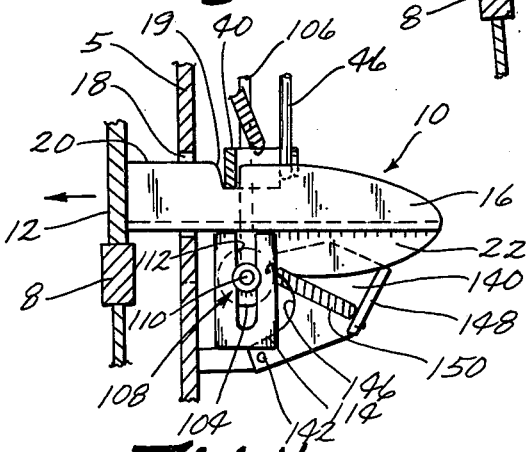
FIG. 11 is a view similar to FIG. 10 but shows the vending member in the "intermediate" position.

With reference to FIG. 2, and in view of the above description, it should be appreciated that spring 32 biases the end 40 of lever 28 against the upper edge 20 of tongue 16, and that if handle 14 of vending member 12 is pulled to open door 8, the withdrawal of tongue 16 to its "intermediate" position shown in FIG. 11, will cause end 40 to ride down into lock-out notch 19, preventing door 8 from opening. Hence, in FIG. 10 vending member 10 is in the "in" position and the lever 28 is in its "unlocked position", and in FIG. 11, vending member 10 is in its "intermediate position" and the lever 28 is in its "locked position".

Unless the lever 28 is somehow held in the unlocked position shown in FIG. 10, while the tongue 16 of vending member 10 is being withdrawn, the vending member 10 will be stopped in its "intermediate position" and door 8 cannot be opened.

Figure 12:
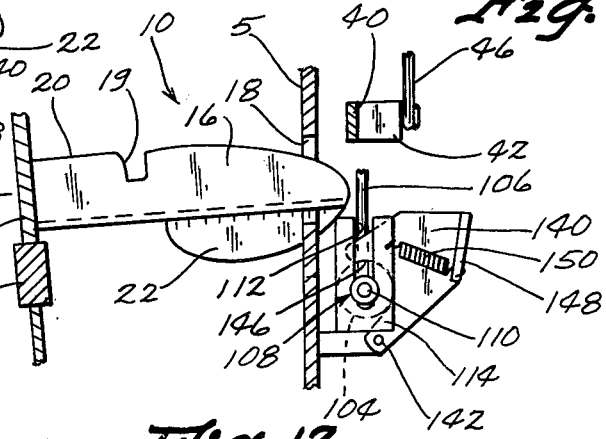
FIG. 12 is a view similar to FIG. 10 but shows the vending member in the "out" position.

The lever holding rod 46 is used cooperatively with the cam structure 60 shown in FIGS. 2–7 to comprise a mechanism for allowing vending member 10 to be moved to the "out" position shown in FIG. 12 when the proper coinage is inserted as will now be described.

Cam structure 60 includes a suitable coin operated mechanism (not shown) such as the SCS Accumulator, or Totalizer, manufactured by the National Register Company of Saint Louis, Mo. A like coin mechanism is also disclosed in U.S. Pat. Nos. 3,545,568 and 3,139,167 referred to above. The mechanism includes an output shaft 62 which has a normal starting position and rotates a specified angular amount depending upon the amount of coinage received by the mechanism. Generally, the greater the value of coinage inserted, the greater the degree of angular rotation. Output shaft 62 of cam structure 60 has a first cam 64 rigidly secured thereto. First cam 64 includes a circular central portion 66 and a radially projecting cam portion 68. Cam portion 68 includes a cam surface 70, and a bearing surface 72.

Figure 4:
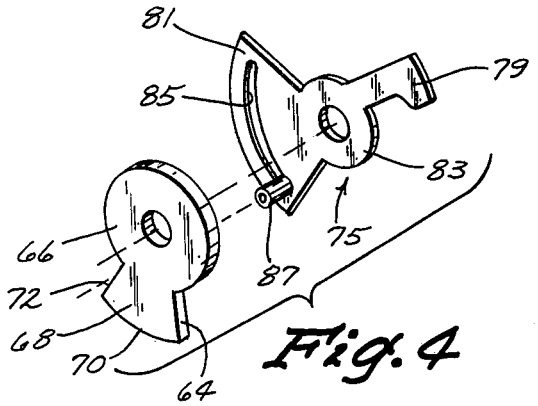
FIG. 4 shows the dual cam structure employed in the present invention.

A second cam 75 is mounted for free rotation on the shaft 62 adjacent first cam 60. A washer member 77 is secured at the end of shaft 62. Second cam 75, as best shown in FIG. 4, has a cam portion 79, weighted portion 81 and pivot portion 83. Weighted portion 81 includes an arcuate slot 85 and an adjustable projection 87 which is releasably secureable along slot 85. The adjustable projection allows the position of the second cam 75 to be varied with respect to the first cam 64, and thereby, increases the adaptability of the present invention to a varied price range. Second cam 75 freely rotates on the shaft 62. It can, thus, be appreciated that due to the greater mass and weight in the weighted portion 81 as compared to cam portion 79, and the positions of cams 62 and 75, second cam 75 is biased by gravity in the counterclockwise direction in FIGS. 2 and 5–7, forcing the projection 87 to abut and press against first cam 64. Second cam 75 is, thus, gravitationally biased by a gravitational biasing force against first cam 64. The coin mechanism includes a reset lever 100, later described.

Cam structure 100 includes an L-shaped stop 89 which is pivotally secured at 91 to housing 5 and serves a purpose which will become apparent. Note that stop 89 can be pivoted by means of a key 93 inserted in keyhole 95 provided at the exterior of housing 5. See FIG. 3.

Figure 5:
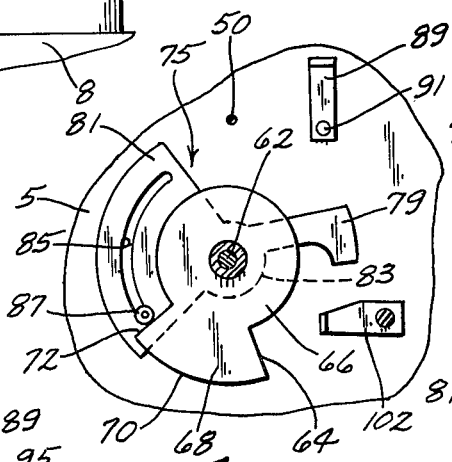
FIG. 5 shows the cam structure of the present invention in its starting position.

As mentioned above, the coin operated mechanism utilized with the present invention rotates the output shaft 62 a specified angular amount depending upon the amount of coinage inserted. First cam 64 is rigidly secured for rotation with shaft 62. FIGS. 2 and 5 show the starting position of the shaft 62, first cam 64 and second cam 75. In the present embodiment, the coin operated mechanism is adjusted to provide rotation to a first position when a set low price amount of coinage is received, and to rotate to a second position when a set high price amount of coinage is received. Here, the low price amount of coinage is 30 cents (for example) for a regular daily newspaper and the high price coinage is 90 cents (for example) for a Sunday newspaper.

Figure 6:
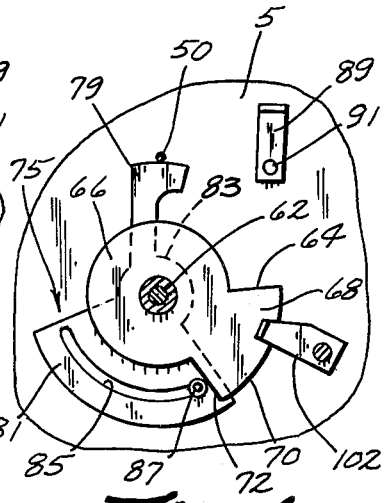
FIG. 6 shows the cam structure of the present invention with the first and second cams in the first position.

With FIG. 5 showing the starting position, FIG. 6 shows the first position which shaft 62, first cam 64 and second cam 75 rotate to when the low price amount of coinage is inserted in the coin mechanism. Note that while shaft 62 and cam 64 are locked in rotation, cam 75 follows due to its gravitational bias exerted thru projection 87 and bearing surface 70 of first cam 64. In this first position, shown in FIG. 6, cam portion 79 of second cam 75 has rotated counterclockwise to a substantially vertical position wherein it is positioned directly below the finger portion 50 of control wire 46. Hence, once the proper low price coinage amount is inserted into the coin mechanism, the cam structure 60 rotates to this first position where second cam 75 blocks the downward movement of lever holding rod 46, and thereby lever 28 is held in its unlocked position as the handle 14 of vending member 10 is moved to its "out" position shown in FIG. 12. Thus, the rotation of the cam structure 60 to this first position permits the vending member 10 to operate, allowing door 8 to open or vend a newspaper.

Figure 7:
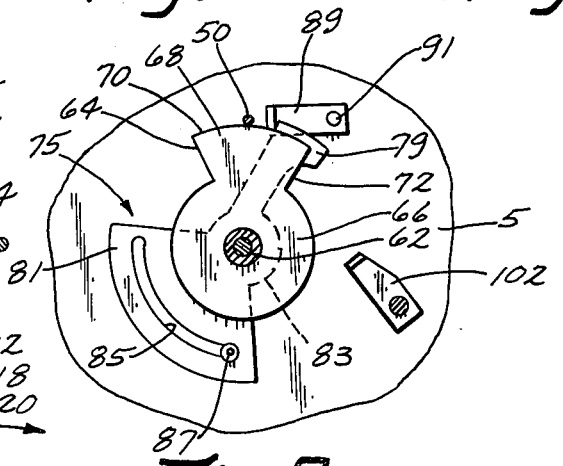
FIG. 7 shows the cam structure of the present invention with the first cam in the second position and the second cam in the blocked position.

If, however, we want to lock the vending member 12 until the high price amount of coinage is received, we must ensure that finger 50 of lever holding rod 46 is not blocked until the insertion of the high price coinage rotates first cam 64 to the second position shown in FIG. 7. To accomplish this, a suitable key 93 is inserted into keyhole 95 from the exterior of housing 5 and the stop 89 rotates from the clear position shown in FIGS. 5 and 6 to the blocking position shown in FIG. 7. With stop 89 thusly positioned, and the proper high cost coinage inserted, first cam 64 will commence rotation and second cam 75 will follow, due to gravity, up the point where it is blocked by stop 89 as shown in FIG. 7. First cam 64 will continue, however, to rotate counterclockwise and finger 50 of lever holding rod 46 will not be blocked until first cam 64 reaches its second position shown in FIG. 7. Thus, the vending member 10 will be unable to assume the "out" position, and door 8 consequently cannot be opened until the proper high cost coinage is inserted causing first cam 64 to rotate to its second position shown in FIG. 7.

The present invention, therefore, provides a means for selecting between a low price and high price vending amount. The vending machine of the present invention, moreover, can be switched from the low price amount to the high price amount simply by means of an externally inserted key. Thus, the housing 5 of the control mechanism need not be opened to change prices.

The invention includes a reset mechanism 100 shown in FIGS. 2 and 8–12. Coin operated mechanisms such as the SCS Totalizer described above include a reset lever 102 shown in FIGS. 2 and 5–7 which rotates simultaneously with the rotation of cam shaft 62. As shown in FIG. 5, the reset lever 102 has a starting position corresponding to the starting position of the shaft 62 and cams 64 and 75. As the shaft 62 and cams 64 and 75 rotate counterclockwise to the first position shown in FIG. 6, the reset lever 102 rotates clockwise to its first position shown in FIG. 6. As the shaft 62 and cam 64 rotate counterclockwise to the second position shown in FIG. 7, the reset lever rotates clockwise to its second position shown in FIG. 7. The coin mechanism 60 is so designed that if the reset lever is pushed, in the counterclockwise direction, from its first or second positions back to its starting position, the shaft 62 and cams 64, 75 will simultaneously rotate clockwise back to their starting position.

Accordingly the reset mechanism 100, now described, pushes the reset lever 102 back to its starting position to reset the shaft 62 and cam 64, 75 after an article has been vended.

Figure 9:
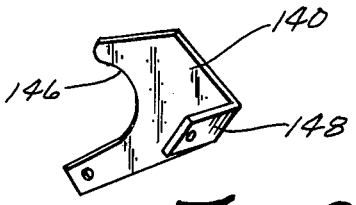
FIG. 9 is a perspective view of the pivoting catch member of the present invention.

Reset mechanism 100 includes a roller 104 supported on an L-shaped shaft 106. The shaft 106 has a leg 108 at its lower end upon which roller 104 is rotatably mounted. The end 110 of leg 108 is slideably received within a vertical slot 112 which is formed within a bracket 114. Bracket 114 is secured to a projection 115 of housing 5. The shaft 106 is slideably supported in a bracket 116 which is secured to housing 5. The upper end 118 of shaft 106 has a bracket 120 rigidly secured thereto. A spring 122 is secured to the bracket 120 at one end and is secured to a support 124 at the other. Support 124 is secured to housing 5. Spring 122 biases shaft 106 upwardly. A compression spring 126 encircles shaft 106 and is compressed between bracket 120 and a tab 127 which is secured to a lever arm 128. Tab 127 is slideably mounted upon shaft 106 and is rigidly secured to lever arm 128. Lever arm 128 is pivoted at one end 130 to a pivot bracket 132 secured to housing 5. A spring 134 is secured at one end to lever arm 128 and at the other to spring bracket 136 secured to housing 5. Spring 134 biases lever arm 128 upwardly, however this upward bias opposed by compression spring 126 which biases the arm 128 downwardly. The end 138 of lever arm 128 opposite end 130 is U-shaped. The lever arm 128 is positioned so that its U-shaped end 138 is positioned above the reset lever 102 of the coin mechanism 60. Returning to the lower end of the shaft 106, a pivoting catch 140 is pivotally mounted at pivot point 142 to projection 115. Projection 115 is secured to housing 5 and carries bracket 114 as aforementioned. Catch 140 is best shown in FIG. 9. It includes an arcuate edge 146 and a projecting tab 148. Arcuate edge 146 conforms to the exterior of roller 104. See FIG. 12. A spring 150 is secured at one end to projecting tab 148 and at the other to bracket 114. The spring 150 biases catch 140 inwardly, or in the counterclockwise direction in FIGS. 10–12.

Reset mechanism 100 operates as follows:

When vending member 10 is in the "in" position shown in FIG. 10, roller 104, shaft 106, and lever arm 128, are in the "up" position. Catch 140 is held in the "out" position shown in FIG. 10, by the reset cam portion 22 of tongue 16. When the proper amount of coinage has been inserted to position cam 64 or 75 under the finger 50 of lock-out wire 46, the vending member 10 can be moved to its "out" position shown in FIG. 12. As the tongue 16 of vending member 10 is retracted through the opening 18 of housing 5, however, the reset cam portion 22 of tongue 16 pushes roller 104 to its "down" position shown in FIG. 12. Catch 140 follows tongue 16, due to the bias of spring 150, and catches or holds roller 104 in the "down" position as shown in FIG. 12. The downward movement of roller 104 is transferred through shaft 106 and compression spring 126 to the lever arm 128. Thus, as the roller 104 is pushed down, the lever arm 128 pivots downwardly or clockwise in FIG. 2. Recall that the reset lever 102 of the coin operated mechanism 60 rotates clockwise to its first or second position as the cams 64, 75 rotate. Due to the downward pivoting movement of lever arm 128, the U-shaped end 138 pushes down on reset lever 102, as the roller 104 moves to its "down" position, and returns the lever 102 to its starting position. By pushing the reset lever 102 back to its starting position, the shaft 62 and cams 64 and 75 are simultaneously returned to their starting position due to the internal workings of coin mechanism 60.

Once the newspaper has been vended, the door 8 is closed and vending member 10 reinserted into opening 18. As vending member 10 enters opening 18, the reset cam portion 22 of tongue 16 passes over roller 104, and contacts the projecting tab 148, pushing catch 140 away from roller 104 and pivoting it clockwise to its "out" position in FIG. 10. With catch 140 pivoted to its "out" position, and inasmuch as a roller 104 is spring biased upward due to the force of springs 122 and 134 on shaft 106, the roller 104 moves to its "up" position shown in FIG. 10, returning the lever arm 128 to its "up" position shown in FIG. 2.

Hence, the reset mechanism 100 of the present invention automatically resets the cams 64, 75 to their starting position after an article has been vended.

Having disclosed the preferred embodiment of the present invention, many variations and modifications thereof would be obvious to those skilled in the art, and the invention is, therefore, intended to be limited only by the scope of the appended claims.

We claim:

1. A mechanical control system for a vending machine having a frame and a vending member, comprising:

coin operated means having a shaft rotatable in response to monetary coins inserted therein, said shaft having a starting position and rotating in a first direction to a first position in response to the insertion of monetary coins of a low price denomination, and rotating to a second position in response to the insertion of monetary coins of a high price denomination;

a first cam rigidly secured to said shaft to rotate with said shaft;

a second cam freely rotatable upon said shaft and having a projection secured thereto, said second cam being gravitationally biased in said first direction and said projection being engageable with said first cam; and a lever holding rod and lever having a "locked" and an "unlocked" position, and being biased to said locked position, said lever holding rod and lever locking said vending member in said locked position and permitting said vending member to vend an article in said unlocked position; said shaft rotating said first cam to said first position in response to the insertion of coinage of a low price denomination and said second cam rotating with said first cam to said first position, due to said gravitational bias in said first direction, said second cam holds said lever holding rod and lever in said unlocked position in said first position and permits said vending member to vend a low price article; said shaft rotating said first cam to a second position in response to the insertion of money coins of a high price denomination, said first cam holding said lever holding rod and lever into said unlocked position in said second position, and permitting said vending member to vend a high price article.

2. The control system of claim 1, further comprising a stop member moveable between a clear position and a blocking position, said stop member blocking the rotation of said second cam in said blocking position, said second cam being unable to rotate to said first position when blocked by said stop member.

3. The control system of claim 2 wherein said control system is enclosed in a housing and said stop member is rotatably secured to the inside of said housing, said stop member being manually rotated by a key inserted into a key passage provided in the exterior of said housing.

4. The control system of claim 1 wherein the said projection is adjustably moveable on said second cam to vary the position said second cam assumes with respect to said first cam.

5. The control system of claim 1 wherein said second cam has a cam portion, a pivot portion and a weighted portion, said pivot portion being disposed intermediate said cam portion and said weighted portion, said projection being disposed from said weighted portion, said shaft being received through said pivot portion and wherein said first cam has a central portion secured to said shaft and a cam portion, said cam portion having a bearing surface.

6. The control system of claim 5, wherein said shaft, said first cam and said second cam have a starting position, said second cam being gravitationally biased in said first direction starting in said first position by a gravitational biasing force said second cam remaining in said starting position due to the engagement of said projection with said bearing surface of said first cam, said second cam following said first cam to said first position due to said gravitational biasing force, said second cam being gravitationally biased in said first direction by said gravitational biasing force in said first position, said second cam being held in said first position by the engagement of said projection with said bearing surface of said first cam.

7. The control system of claim 1, wherein said lever holding rod is secured to said lever and said lever is biased to said locked position and has an unlocked position, said vending member having an upper edge and a lock-out notch, an "in" position and an "intermediate" position and an "out" position, said lever being biased against said upper edge when said vending member is in said "in" position, said vending member being moveable from said "in" position to said "intermediate" position wherein said lever moves into said lock-out notch to lock said vending member when said lever holding rod is not held in said unlocked position by said first or second cam, said vending member being moveable from said "in" position through said "intermediate" position to said "out" position when said lever holding rod is held in said unlocked position by said first or second cam to prevent said lever from moving from said unlocked to said locked position.

8. The control mechanism of claim 1, further including a means for resetting said first and second cams to said starting position, said coin operated means having a reset lever, said reset means engaging said reset lever to reset said shaft and said first and second cams once an article has been vended.

9. The control mechanism of claim 8 wherein said reset mechanism comprises a lever pivotally connected to said housing at one end and spring biased upwardly, a portion of said lever being disposed above said reset lever, a reset shaft attached to said lever and slideably secured to said housing, said reset shaft being spring biased upwardly, said reset shaft having a roller secured at its lower end, said vending member including a tongue, said tongue having a reset cam portion, a catch member being pivotally connected to said housing and spring biased against said roller; said reset lever of said coin operated means having a starting position and rotating as said shaft and said first and second cams rotate, said shaft and said first and second cams rotating back to their starting position when said reset lever is moved back to its starting position; said roller, said reset shaft and said lever being in an "up" position when said vending member is in said "in" position, the movement of said vending member from said "in" position to said "out" position causing said reset cam portion to push said roller, said reset shaft and said lever to a "down" position, said lever moving said reset lever to its starting position, said catch holding said roller in said "down" position, the movement of said vending member from said "out" position to said "in" position causing said reset cam portion to push said catch away from said roller to allow said roller, said reset shaft and said lever to move to said "up" position.

* * * * *